United States Patent [19]

Farner et al.

[11] Patent Number: 5,066,257

[45] Date of Patent: Nov. 19, 1991

[54] PROCESS FOR PRODUCING FLAT PLATE ILLUMINATION DEVICES

[76] Inventors: Peter W. Farner, 3315 Lorraine, Kalamazoo, Mich. 49008; Franklin H. Cocks, 5 Learned Pl., Durham, N.C. 27705

[21] Appl. No.: 477,714

[22] Filed: Feb. 9, 1990

[51] Int. Cl.[5] ..... H01J 9/39

[52] U.S. Cl. ..... 445/26; 445/25; 445/41

[58] Field of Search ..... 445/24, 25, 41, 55, 445/26

[56] References Cited

U.S. PATENT DOCUMENTS

| | | | |
|---|---|---|---|
| 1,825,399 | 9/1931 | Hotchner | 313/515 |
| 1,949,963 | 3/1934 | Hotchner | 313/515 |
| 2,263,164 | 11/1941 | Dailey | 445/55 |
| 4,584,501 | 4/1986 | Cocks et al. | 313/493 |
| 4,839,555 | 6/1989 | O'Mahoney | 445/25 |

*Primary Examiner*—Kenneth J. Ramsey

[57] ABSTRACT

A multistep process is disclosed which enables hermetically sealed, durable, long-lasting illumination devices which utilize electrical discharges through inert gas and inert gas/mercury vapor mixtures to be produced in an essentially flat-plate configuration without the use of glass tubing to contain the discharge. This process utilizes plates of glass having a particular range of thermal expansion coefficients for the preparation of these display devices through the discovery of a heating/cooling process that enables these thick glass assemblies to be produced rapidly yet without cracking and without significant residual air or water vapor contamination and which includes the heat sealing of a evacuation/-backfilling tubulation in the same sequence and also includes the unique feature of the inclusion of finely divided powder in the inert gas chamber which, when subjected to the heating/cooling cycle, acts to getter residual air and water vapor from the inert gas. This process also utilizes a special means for preventing the adhesion of the flat plates to the platens used for their support during the thermal fusing treatment that is required to form the gas discharge channels. An interrupt step, introduced after fusion bonding is complete, enables the usage of a low softening point glass having a thermal expansion coefficient compatible with that of the window glass to produce the evacuation and gas filling tubulation port.

11 Claims, No Drawings

PROCESS FOR PRODUCING FLAT PLATE ILLUMINATION DEVICES

SUMMARY OF THE INVENTION

This invention provides a unique process which enables the semi-automated, continuous preparation of hermetically sealed, durable, essentially flat-plate illumination devices to be produced economically and at a high rate of production. This process incorporates features which enable the usage of glass with a particular range of thermal expansion coefficients to produce high intensity illumination devices without cracking during the thermal fusing step. The light from these devices is produced by a gas discharge through inert gas or inert gas/mercury vapor mixtures that are contained in one or more channels cut into the glass and rendered into hermetically sealed passages by the thermal fusing of front and back glass plates to a middle glass plate into which the channels have been cut. This cutting process, which can require the removal of a substantial portion of the glass comprising the middle plate, is achieved by the use of an extremely high pressure water jet which carries abrasive grit and whose cutting action is computer controlled so as to make the cutting of highly complex shapes possible in a rapid manner. Hermetic sealing of the front and back plates to the middle plate is accomplished by means of a controlled thermal fusing process carried out using a novel, coated support platen, and this thermal process also incorporates a special step which enables the evacuation tubulation to be made from a glass of similar thermal properties, especially thermal expansion coefficient, as the glass which comprises the plates themselves. The evacuation of the air from the hermetic channel and the subsequent backfilling of this channel with inert gas or inert gas/mercury vapor is carried out while the hermetically sealed assembly is still hot from thermal sealing. By including in the gas discharge channel a quantity of finely divided powder, by subjecting this powder to the thermal cycle used to fuse the glass plates, and by carrying out final, hermetic sealing before final cooling, it has been discovered that this powder can than act to getter residual air and water vapor from the inert gas so that so-called bombarding or the use of metallic getters are not necessary. The electrical power is supplied by means of electrodes introduced into the assembly before sealing. An additional critical step is the discovery of a process step which allows the entire assembly to be carried through the thermal fusing treatment without adhesion to the support platen which carries the glass while this glass is hot and soft. The result of this novel process is an essentially flat-plate illumination device which is physically robust, has a high illumination intensity and a long life, and which can be made rapidly and in quantity by a semi-automated process with a high production yield.

OBJECTS OF THE INVENTION

It is an object of the invention to produce large, essentially flat-plate gas discharge illumination devices in a semi-automated, economical, continuous manner.

It is another object of the invention to provide a process for the production of gas discharge illumination devices which does not involve the use of tubes to shape the discharge path.

It is yet another object of the invention to provide a process for the production of neon advertising signs which process is capable of a substantial degree of automation and does not involve the handwork of artisans for the preparation of these advertising devices.

It is still another object of the invention to provide a process for the production of gas discharge illumination devices which can make the production of such devices sufficiently economical, so that such devices can be considered for both domestic and public lighting purposes.

BACKGROUND OF THE INVENTION

Luminous devices based upon the use of contained, glowing electrical discharges through inert gases, especially neon, are well known. Neon signs, for example, are commonly seen in everyday use. Neon signs, however, utilize glass tubes bent to form the desired shape and contain electrodes at the ends of the glass tubes. Other devices which utilize gas discharges for producing illumination without using bent glass tubes are known or have been proposed. U.S. Pat. No. 1,949,963 for example describes the use of multiple flat plates assembled to produce an inclosed channel which can act as a neon sign. In this case five glass plates are used, including solid front and back plates together with three middle plates which contain both channels and perforations between the channels. U.S. Pat. No. 1,825,399 utilizes only two glass plates together with the use of either engraved passages or tubular holes angled with respect to the plane of the glass plates to form the continuous gas discharge pathway. U.S. Pat. No. 4,584,501 also provides a flat-plate, gas discharge device which can be used in combination with both front and rear mirrors to produce a device which shows an infinite sequence of signs of ever decreasing intensity. None of these patents, however, disclose the process by which such devices can be produced in a semi-automated, economical, continuous manner. Yet it is precisely the invention of such an economical production process which will determine the ultimate widespread utility of such illumination devices.

DESCRIPTION OF PREFERRED EMBODIMENTS

One preferred embodiment of this invention comprises a high pressure water jet cutting device whose cutting action is augmented by the addition of garnet abrasive to the water jet so that linear cutting rates of up to 100 inches per minute can be achieved in cutting through glass plates between 3/32 and 13/32 inches thick to form the basic channel to contain the gas discharge. The cut glass plate thus produced, denoted as the middle plate, is transferred to a glass back plate, which itself is between 5/64 and 13/32 inches thick, partly to support the fragile pattern produced by the water jet cutting action and partly also to provide a bottom to the channels produced by the cutting action so that fluorescent or other powdered substances can be placed in this channel and retained within it. At this point also the integral, interior electrodes required to provide electrical power for the gas discharge are also placed within the as yet non-hermetic channel at its end points and connected to the exterior by means of electrical feed-throughs. A front plate is then placed over the assembled middle and back plates, the electrical connections to the electrodes passing through holes drilled, by water jet cutting, in the front plate. The entire assembly is then placed on a platen support, said platen support being preferably of a high melting point ceramic material such as an alumina-rich ceramic. It has now been discovered that if said ceramic platen has been coated with a ceramic powder, such as alumina powder, said powder having a sieve size less than 200 mesh and and a softening point substantially in excess of that of the glass plates, said powder having been applied to the platen by spraying, washing, or other suitable means and lightly fired to the surface of said platen so that it is mildly adherent to said platen, then the glass plates will not adhere to the support platen, even though the glass plates are thoroughly softened and made sticky at the high temperature to which it is heated during sealing. After placement on the coated platen, glass frit, such as Corning 7075, is placed around the electrode wires. The combined glass plates and platen assembly are then subjected to a sealing step to soften and to seal the plates hermetically. In this step the plates and platen are heated to between 1200 degrees Fahrenheit and 1450 degrees Fahrenheit at a rate between 1 and 25 degrees Fahrenheit per minute and then cooled to between 1000 and 750 degrees Fahrenheit at a rate between one half and 15 degrees Fahrenheit per minute. It is important that the glass plates have thermal expansion coefficients which lie between 65 and 110 inches per inch per degree Centigrade. At this lower temperature, between 1000 and 750 degrees Fahrenheit, the process is subjected to an interrupt step, during which interrupt step the evacuation tubulation is inserted into a previously drilled hole in the back plate, said hole communicating with the channel that was cut into the middle plate by water jet cutting. Said tubulation can thus have a similar expansion coefficient and a similar softening point as the glass plates, both the expansion coefficient and the softening point being related. That is, the higher the softening point of a glass, the lower will be its expansion coefficient, and conversely the lower the softening point the higher will be its expansion coefficient. This tubulation is encircled during or after placement by a relatively low melting point glass frit that serves to hermetically seal the tubulation to the front plate. After this tubulation has been inserted, the cooling process is continued until a temperature of between 150 and 550 degrees Fahrenheit has been reached, at which point an air and water gettering metallic material, such as zirconium metal, can be inserted into the tubulation and an evacuation coupling is made to this tubulation, following which the air is substantially all removed from the gas discharge passage and the electrodes are separately heated by radio frequency heating or other means to desorb air and water vapor contamination that is adsorbed on them, and the desired inert gas or inert gas/mercury vapor mixture is then backfilled in to this passage. Because the assembly is still hot, it has been discovered that the filling pressure must be between 2.5 and 30 millibar in total pressure in order that the device functions properly at room temperature. The tubulation is then sealed by fusing and pinching or crimping the tubulation shut. The air or water vapor gettering material is then activated by radio frequency heating or other means to remove any residual air or water vapor contamination. After final cooling to room temperature, the desired art-work is applied to the front of the device and the power supply connected to the electrodes to produce the finished illumination device.

In another preferred embodiment, it has been accidentally discovered that the use of a metal material for gettering may be omitted, provided that within the walls of the channel in which the gas discharge will take place there has been applied a finely divided powder such as yttrium oxide, calcium tungstate, calcium silicate, or barium titanium phosphorus oxide. In the preparation of neon signs, it is common to use fluorescent or phosphorescent powders to give color to the inert gas/mercury vapor discharge. However, in the preparation of such signs, the entire tube is never heated to above its softening point, and the evacuation of such tubes prior to backfilling with inert gas or inert gas/mercury mixtures is difficult and can not usually be accomplished successfully without the use of a so-called bombarding step, whereby a very high power electrical discharge is passed through the tube when it contains in order to release adsorbed air and moisture into this inert gas, which contaminated inert gas is then removed by evacuation and then replaced with fresh inert gas. Alternatively, metallic gettering substances may also be used as described in the first embodiment. We have accidentally discovered, however, that when finely divided powders and the glass plates including the walls of the said channel or channels are subjected to the heating cycle described in the previous embodiment, these powders become capable of absorbing both residual air and water vapor when cooled essentially to room temperature. Since, in the process described here the said powders are in hermetically sealed channels under inert gas, the only air or water vapor that they can absorb at room temperature is that air and water vapor which remains as a contaminant in the channels. Thus, it is possible to dispense with both the bombarding process and the use of a gettering material by means of the use of finely divided powders, especially powders of substances such as yttrium oxide, calcium tungstate, calcium silicate, barium titanium phosphide oxide, or aluminum oxide. In cases where the desired color is that of a neon gas discharge itself, we have discovered that by omitting the use of mercury vapor but including the use of pure neon, and by placing the powder on the back of the channel only, that both successful gettering and the production of the pure color of neon may be achieved. In normal neon signs, mercury vapor is always used when phosphors or other fluorescent materials are used, and additionally when phosphors are used, they are always applied to the complete circumference of the interior of the tubing.

We claim:

1. A process for producing flat-plate, gas discharge, illumination devices which comprises a cutting step utilizing a high pressure water jet, said water jet carrying an abrasive grit, an assembly step comprising the placing of the integral, interior electrodes in the channels cut into a middle plate by said cutting step, together with the assembly of front and back plates about said middle plate to form a non-hermetic channel containing electrodes, said plates being assembled on the surface of a carrier platen, said carrier platen being covered with a ceramic powder to prevent adhesion of said bottom plate to said carrier platen, said ceramic powder having a sieve size less than 200, a sealing step comprising the heating of the combination of top, middle, and bottom plates, and said carrier platen to a temperature sufficiently high to soften and to seal said top, middle, and bottom plates hermetically together, including the hermetic sealing of electrical feed-throughs to the said electrodes by means of glass frit, a cooling step, comprising the cooling of the tubulated assembly to a temperature low enough to allow evacuation hoses to be connected to said tube, an evacuation and backfilling step comprising the evacuation of air from the said channel and the replacement of this evacuated air by backfilling the said channel with the desired fill gas, a final sealing step comprising the hermetic sealing of the said evacuation and backfilling tube.

2. The process described in claim 1 wherein the said sealing step is carried out by heating at heating rates between 2 and 25 degrees Fahrenheit per minute to a final temperature between 1200 degrees Fahrenheit and 1450 degrees Fahrenheit followed by cooling at rates between 1 degree Fahrenheit and 15 degrees Fahrenheit per minute to a temperature of between 150 degrees Fahrenheit and 500 degrees Fahrenheit.

3. The process described in claim 1 which additionally has an interrupt step that is carried out during cooling from the highest temperature reached, said interrupt step occurring when the temperature is between 1000 degrees Fahrenheit and 750 degrees Fahrenheit, said interrupt step comprising the insertion of a tubulation into a hole in said front plate, said tubulation comprising a glass tube, said glass tube having a thermal expansion coefficient similar to that of the glass which comprises the flat glass plates, said tube being sealed to said plates by means of a low melting point glass frit.

4. The process described in claim 1 wherein the said backfilling step includes the backfilling of the said channel to a pressure of between 2.5 and 30 millibars.

5. The process described in claim 1 which additionally comprises the heating of the electrodes by radiofrequency heating to desorb adsorbed air and water vapor.

6. In a process for the preparation of essentially flatplate, gas discharge illumination devices, the application of a finely divided powder to the walls of the channels which contain the gas discharge, the heating of both the powder and the walls themselves to a temperature high enough to activate the said powder, followed by the evacuation, backfilling and hermetic sealing of the said channel with an inert gas before the said powder and channel are cooled to room temperature whereby the said powder acts as a getter to remove water vapor and residual air from the inert gas when cooled to room temperature and electrical power is applied to the illumination device.

7. The process described in claim 6, wherein the finely divided powder contains aluminum oxide.

8. The process described in claim 6, wherein the finely divided powder contains yttrium oxide.

9. The process described in claim 6, wherein the finely divided powder contains calcium tungstate.

10. The process described in claim 6 wherein the finely divided powder contains calcium silicate.

11. The process described in clain 6 wherein the finely divided powder contains barium titanium phosphorous oxide.

* * * * *